US005156655A

United States Patent [19]

Baillargeon et al.

[11] Patent Number: 5,156,655

[45] Date of Patent: Oct. 20, 1992

[54] MULTIFUNCTIONAL ADDITIVES TO IMPROVE THE LOW-TEMPERATURE PROPERTIES OF DISTILLATE FUELS AND COMPOSITIONS CONTAINING SAME

[75] Inventors: David J. Baillargeon, Cherry Hill; Angeline B. Cardis, Florence; Dale B. Heck, West Deptford, all of N.J.

[73] Assignee: Mobil Oil Corp., Fairfax, Va.

[21] Appl. No.: 622,585

[22] Filed: Dec. 3, 1990

[51] Int. Cl.[5] ..... C10L 1/22

[52] U.S. Cl. ..... 44/405; 44/386; 44/391; 560/88; 560/89

[58] Field of Search ..... 44/386, 391, 405; 560/88, 89

[56] References Cited

U.S. PATENT DOCUMENTS 3,502,712 3/1970 De Brunner .
3,530,074 9/1970 De Brunner .
4,744,798 5/1988 Andress ..... 44/386
5,002,589 3/1991 Baillargeon et al. .
5,039,306 8/1991 Baillargeon et al. .
5,039,309 8/1991 Baillargeon et al. .

OTHER PUBLICATIONS

Morrison and Boyd, *Organic Chemistry,* 3rd Ed., pp. 564-567.

*Primary Examiner*—Olik Chaudhuri
*Assistant Examiner*—M. Nuzzolillo
*Attorney, Agent, or Firm*—Alexander J. McKillop; Charles J. Speciale; Howard M. Flournoy

[57] ABSTRACT

The reaction products of benzophenone tetracarboxylic dianhydride and aminoalcohols and/or amines with long chain hydrocarbyl groups attached improve the low-temperature properties of distillate fuels when added thereto in minor amounts.

35 Claims, No Drawings

MULTIFUNCTIONAL ADDITIVES TO IMPROVE THE LOW-TEMPERATURE PROPERTIES OF DISTILLATE FUELS AND COMPOSITIONS CONTAINING SAME

BACKGROUND OF THE INVENTION

This application is directed to novel benzophenone ester and ester/amide additive reaction products which are useful for improving the low-temperature properties of distillate fuels, and fuel compositions containing same.

Traditionally, the low-temperature properties of distillate fuels have been improved by the addition of kerosene, sometimes in very large amounts (5–70 wt %). The kerosene dilutes the wax in the fuel, i.e. lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity, however; most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. No art is known to applicants which teaches or suggests the additive products and compositions of this invention.

SUMMARY OF THE INVENTION

The novel esters and ester/amides prepared in accordance with this invention have been found to be surprisingly active wax crystal modifier additives for distillate fuels. Distillate fuel compositions containing <0.1 wt % of such additives demonstrate significantly improved low-temperature flow properties, i.e. lower cloud point and lower CFPP filterability temperature.

These additives are ester or ester/amide products which have core-pendant group (star-like) structures derived from the reaction of benzophenone tetracarboxylic dianhydride (BTDA) with either (1) an aminoalcohol, the product of an amine and an epoxide, to give ester products or (2) a combination of an aminoalcohol (above 1) with an amine to give ester/amide products. The aminoalcohol, above, may also encompass a combination of two or more different aminoalcohols.

Thus an object of this invention is to improve the low-temperature flow properties of distillate fuels. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

The compositions of these additives are unique. Also, the additive concentrates and fuel compositions containing such additives are unique. Similarly, the processes for making these additives, additive concentrates, and fuel compositions are unique.

DESCRIPTION OF PREFERRED EMBODIMENTS

The additives of this invention have core-pendant group (star-like) structures. The core structure is derived from benzophenone tetracarboxylic dianhydride (BTDA) or its acid equivalent, and suitable pendant groups derived from alcohols and amines with some combination of linear hydrocarbyl groups attached. The pendant groups include (1) aminoalcohols, derived from a secondary fatty amine capped with an olefin epoxide, and (2) combinations of an aminoalcohol (from 1 above) and an amine. The additives are reaction products obtained by chemically combining the core structure and the pendant group(s) in differing ratios using standard techniques for esterification/amidification.

For example, a general structure for the BTDA/aminoalcohol ester is as follows:

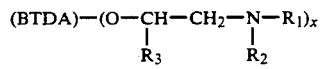

A general structure for the BTDA/aminoalcohol/amine ester/amide is as follows:

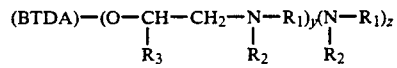

Where:

$x=y+z=0.5–4$ $R_1$, $R_3=C_8–C_{50}$ linear hydrocarbyl groups, either saturated or unsaturated.

$R_2=R_1$, $C_1–C_{100}$ hydrocarbyl.

Suitable amines, as indicated above, are secondary amines with at least one long-chain hydrocarbyl group. In this invention, stoichiometries of amine to epoxide were chosen such that one amine reacted with each available epoxide functional group. Other stoichiometries where the amine is used in lower molar proportions may also be used. Highly useful secondary amines include but are not limited to di(hydrogenated tallow) amine, ditallow amine, dioctadecylamine, methyloctadecylamine and the like.

The reactions can be carried out under widely varying conditions which are not believed to be critical. The reaction temperatures can vary from about 100° to 225° C., preferably 120° to 180° C., under ambient or autogenous pressure. However slightly higher pressures may be used if desired. The temperatures chosen will depend upon for the most part on the particular reactants and on whether or not a solvent is used. Solvents used will typically be hydrocarbon solvents such as xylene, but any non-polar, unreactive solvent can be used including benzene and toluene and/or mixtures thereof.

Molar ratios, less than molar ratios or more than molar ratios of the reactants can be used. Preferentially a molar ratio of 1:1 to about 8:1 of epoxide to amine is chosen.

The times for the reactions are also not believed to be critical. The process is generally carried out in from about one to twenty-four hours or more.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T, Typical jet fuels are defined in Military Specification MIL-F-5624B.

The following examples are illustrative only and are not intended to limit the scope of the invention.

EXAMPLE 1

Preparation of Additive 1

Di(hydrogenated tallow) amine (50.0 g, 0.10 mol; e.q. Armeen 2HT from Akzo Chemie), and 1,2-epoxyoctadecane (33.6 g, 0.125 mol; e.q. Vikolox 18 from Viking Chemical) were combined and heated at 160° C. for 24 hours. Benzophenone tetracarboxylic dianhydride (8.86 g, 0.0275 mol; e.q. BTDA from Allco Chemical Corp.), and xylene (approx. 50 ml) were added and heated at reflux (180°–220° C.) with azeotropic removal of water for 24 hours. Volatiles were then removed from the reaction medium at 180°–220° C., and the reaction mixture was hot filtered to give 71.9 g of the final product as a low-melting solid.

EXAMPLE 2

Preparation of Additive 2

According to the procedure used for Example 1 (above), di(hydrogenated tallow) amine (50.0 g, 0.10 mol), and 1,2-epoxyoctadecane (33.6 g, 0.125 mol) were first combined. Benzophenone tetracarboxylic dianhydride (10.7 g, 0.0333 mol) was then added, and allowed to react in the second step of the sequence. The final product (86.4 g) was obtained as a low-melting solid.

EXAMPLE 3

Preparation of Additive 3

According to the procedure used for Example 1 (above), di(hydrogenated tallow) amine (50.0 g, 0.10 mol), and 1,2-epoxyoctadecane (33.6 g, 0.125 mol) were first combined. Benzophenone tetracarboxylic dianhydride (16.1 g, 0.050 mol) was then added, and allowed to react in the second step of the sequence. The final product (87.2 g) was obtained as a low-melting solid.

EXAMPLE 4

Preparation of Additive 4

According to the procedure used for Example 1 (above), di(hydrogenated tallow) amine (62.4 g, 0.125 mol), and 1,2-epoxyoctadecane (21.0 g, 0.078 mol) were first combined. Benzophenone tetracarboxylic dianhydride (11.1 g, 0.0343 mol) was then added, and allowed to react in the second step of the sequence. The final product (86.6 g) was obtained as a low-melting solid.

EXAMPLE 5

Preparation of Additive 5

According to the procedure used for Example 1 (above), di(hydrogenated tallow) amine (62.4 g, 0.125 mol), and 1,2-epoxyoctadecane (21.0 g, 0.078 mol) were first combined. Benzophenone tetracarboxylic dianhydride (14.8 g, 0.0458 mol) was then added, and allowed to react in the second step of the sequence. The final product (89.8 g) was obtained as a low-melting solid.

EXAMPLE 6

Preparation of Additive 6

According to the procedure used for Example 1 (above), di(hydrogenated tallow) amine (62.4 g, 0.125 mol), and 1,2-epoxyoctadecane (21.0 g, 0.078 mol) were first combined. Benzophenone tetracarboxylic dianhydride (22.2 g, 0.0687 mol) was then added, and allowed to react in the second step of the sequence. The final product (95.2 g) was obtained as a low-melting solid.

EXAMPLE 7

Preparation of Additive 7

According to the procedure used for Example 1 (above), ditallow amine (49.8 g, 0.10 mol), e.g. Armeen 2T from Akzo Chemie), and 1,2-epoxyoctadecane (33.6 g, 0.125 mol) were first combined. Benzophenone tetracarboxylic dianhydride (8.86 g, 0.0275 mol) was then added, and allowed to react in the second step of the sequence. The final product (81.8 g) was obtained as a low-melting solid.

EXAMPLE 8

Preparation of Additive 8

According to the procedure used for Example 1 (above), di(hydrogenated tallow) amine (40.0 g, 0.080 mol), and 1,2-epoxyeicosane (28.7 g, 0.088 mol); e.g. Vikolox 20 from Viking Chemical) were combined at 220° C. Benzophenone tetracarboxylic dianhydride (14.2 g, 0.044 mol) was then added, and allowed to react in the second step of the sequence. The final product (71.2 g) was obtained as a low-melting solid.

EXAMPLE 9

Preparation of Additive 9

According to the procedure used for Example 1 (above), di(hydrogenated tallow) amine (40.0 g, 0.080 mol), and a mixture of $C_{20}$–$C_{24}$ alpha olefin epoxides (30.4 g, 0.088 mol; e.g. Vikolox 20–24 from Viking Chemical) were combined at 220° C. Benzophenone tetracarboxylic dianhydride (14.2 g, 0.044 mol) was then added, and allowed to react in the second step of the sequence. The final product (75.1 g) was obtained as a low-melting solid.

EXAMPLE 10

Preparation of Additive 10

According to the procedure used for Example 1 (above), di(hydrogenated tallow) amine (35.0 g, 0.070 mol), and a mixture of $C_{24}$–$C_{28}$ alpha olefin epoxides (33.7 g, 0.077 mol; e.q. Vikolox 24–28 from Viking Chemical) were combined at 220° C. Benzophenone tetracarboxylic dianhydride (12.4 g, 0.0385 mol) was then added, and allowed to react in the second step of the sequence. The final product (74.2 g) was obtained as a low-melting solid.

Preparation of Additive Concentrate

A concentrate solution of 100 ml total volume was prepared by dissolving 10 g of additive in mixed xylenes solvent. Any insoluble particulates in the additive concentrate were removed by filtration before use. Generally speaking however, each 100 ml of concentrate solution may contain from about 1 to about 50 grams of the additive product of reaction.

| Test Fuel Characteristics | |
|---|---|
| | FUEL A: |
| API Gravity | 35.5 |
| Cloud Point (°F.) | |
| Auto CP | 15 |
| Herzog | 16.4 |
| Pour Point (°F.) | 10 |
| CFPP, (°F.) | 9 |
| | FUEL B: |
| API Gravity | 34.1 |
| Gloud Point (°F.) | |
| Auto CP | 22 |

-continued

| Test Fuel Characteristics | |
|---|---|
| Herzog | 23.4 |
| CFPP. (°F.) | 16 |
| POUR POINT (°F.) | 0 |

Test Procedures

The cloud point of the additized distillate fuel was determined using two procedures: (a) an automatic cloud point test based on the commercially available Herzog cloud point tester; test cooling rate is approximately 1° C./min. Results of this test protocol correlate well with ASTM D2500 methods. The test designation (below) is "HERZOG." (b)an automatic cloud point test based on the equipment/procedure detailed in U.S. Pat. No. 4,601,303; the test designation (below) is AUTO CP.

The low-temperature filterability was determined using the Cold Filter Plugging Point (CFPP) test. This test procedure is described in "Journal of the Institute of Petroleum," Volume 52, Number 510, June 1966, pp. 173–185. Test results may be found in the Table below.

TABLE

ADDITIVE EFFECTS ON THE CLOUD POINT AND FILTERABILITY (CPFF) OF DISTILLATE FUEL (ADDITIVE CONCENTRATION = 0.1 WT %)

| | Improvement in Performance Temperature (°F.) | | | | | |
|---|---|---|---|---|---|---|
| | Diesel Fuel A | | | Diesel Fuel B | | |
| | Cloud Point | | | Cloud Point | | |
| Additive | (Auto CP) | (Herzog) | CFPP | (Auto CP) | (Herzog) | CFPP |
| 1 | 3 | 1.3 | 3 | 7.5 | 6.1 | 2 |
| 2 | 4 | 2.8 | 6 | 7 | 6.3 | 7 |
| 3 | 3 | 3.7 | 4 | 9 | 7.9 | 15 |
| 4 | 3 | 2.5 | 6 | 9 | 7.6 | 4 |
| 5 | 4 | 2.9 | 6 | 8 | 7.4 | 4 |
| 6 | 3 | 3.6 | 2 | 6 | 5.8 | 4 |
| 7 | 3 | 3.4 | 6 | 6 | 5.8 | 2 |
| 8 | 2 | 1.6 | 6 | 8 | — | 13 |
| 9 | 1 | 0.7 | 6 | 8 | 9 | 13 |
| 10 | 1 | — | 6 | 7 | — | 11 |

The above test results clearly demonstrate the improved low-temperature characteristics of distillate fuel compositions having additives in accordance with this invention incorporated therein.

We claim:

1. A product of the reaction of benzophenone tetracarboxylic dianhydride or its acid equivalent and (1) an aminoalcohol or mixture of aminoalcohols or a combination of (2) an aminoalcohol or mixture of aminoalcohols and a secondary amine said reactants being reacted in substantially molar, less than molar or more than molar amounts at temperatures varying from about 85° to about 250° C. under pressures varying from about ambient or autogeneous to slightly higher for a time sufficient to obtain the desired ester or ester/amide additive product of reaction and wherein the aminoalcohol is derived from an olefin epoxide and a secondary amine.

2. The product of claim 1 wherein the aminoalcohol is derived from di(hydrogenated tallow)amine and 1,2-epoxyoctadecane.

3. The product of claim 1 wherein the aminoalcohol is derived from ditallow amine and 1,2-epoxyoctadecane.

4. The product of claim 1 wherein the aminoalcohol is derived from di(hydrogenated tallow)amine and 1,2-epoxyeicosane.

5. The product of claim 1 wherein the epoxide is a mixture of $C_{20}$ to $C_{24}$ alpha olefin epoxides.

6. The product of claim 1 wherein the epoxide is a mixture of $C_{24}$ to $C_{28}$ alpha olefin epoxides.

7. The product of claim 1 wherein said reaction product is a benzophenone tetracarboxylic dianhydride/aminoalcohol ester having the following structure:

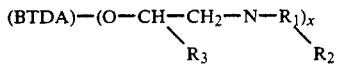

Where:

$x=0.5$–4

$R_1$, $R_3=C_8$–$C_{50}$ linear hydrocarbyl groups, either saturated or unsaturated and $R_2=C_1$–$C_{100}$ hydrocarbyl or $C_8$–$C_{50}$ linear hydrocarbyl groups.

8. The product of claim 1 wherein said reaction product is a benzophenone tetracarboxylic dianhydride/aminoalcohol/amine ester/amide having the following structure:

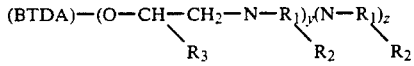

Where:

$y+z=0.5$–4

$R_1$, $R_3=C_8$–$C_{50}$ linear hydrocarbyl groups, either saturated or unsaturated and $R_2=C_1$–$C_{100}$ hydrocarbyl or $C_8$–$C_{50}$ linear hydrocarbyl groups.

9. The product of claim 1 wherein the amine is selected from the group consisting of ditallow amine, di(hydrogenated tallow) amine, dioctadecylamine, methyloctadecylamine or mixtures thereof.

10. An improved fuel composition comprising a major proportion of a liquid hydrocarbon fuel and a minor low temperature improving amount of the reaction product of a benzophenone tetracarboxylic dianhydride or acid equivalent and (1) an aminoalcohol or mixture of aminoalcohols or (2) a combination of an aminoalcohol or mixture of aminoalcohols and a secondary amine said reactants being reacted in substantially molar, less than molar or more than molar amounts at temperature varying from about 85° to 250° C. under pressures varying from about ambient or autogenous to slightly higher for a time sufficient to obtain the desired ester or ester/amide additive product of reaction and wherein the aminoalcohol is derived from an olefin epoxide and a secondary amine.

11. The fuel composition of claim 10 comprising from about 0.001% to about 10% by weight of the total composition of said additive reaction product.

12. The fuel composition of claim 10 wherein the aminoalcohol is derived from di(hydrogenated tallow-)amine and 1,2-epoxyoctadecane.

13. The fuel composition of claim 10 wherein the olefin epoxide is 1,2-epoxyoctadecane and the amine is ditallow amine.

14. The fuel composition of claim 10 wherein the epoxide is 1,2-epoxyeicosane and the amine is di(hydrogenated tallow)amine.

15. The fuel composition of claim 12 wherein the epoxide is a mixture of $C_{20}$ to $C_{24}$ alpha olefin epoxides.

16. The fuel composition of claim 10 wherein the epoxide is a mixture of $C_{24}$ to $C_{28}$ olefin epoxides.

17. The fuel composition of claim 10 wherein said reaction product is a benzophenone tetracarboxylic dianhydride/aminoalcohol having the following structure:

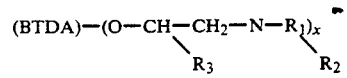

Where:

$x=0.5$–4

$R_1$, $R_3=C_8$–$C_{50}$ linear hydrocarbyl groups, either saturated or unsaturated and $R_2=C_1$–$C_{100}$ hydrocarbyl or $C_8$–$C_{50}$ linear hydrocarbyl groups.

18. The fuel composition of claim 10 wherein said reaction product is a benzophenone tetracarboxylic dianhydride/aminoalcohol/amine ester/amide having the following structure:

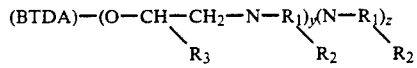

Where:

$y+z=0.5$–4

$R_1$, $R_3=C_8$–$C_{50}$ linear hydrocarbyl groups, either saturated or unsaturated and $R_2=C_1$–$C_{100}$ hydrocarbyl or $C_8$–$C_{50}$ linear hydrocarbyl groups.

19. The fuel composition of claim 10 wherein the amine is selected from the group consisting of ditallow amine, di(hydrogenated tallow) amine, dioctadecylamine, methyloctadecylamine or mixtures thereof.

20. The composition of claim 10 wherein the fuel is a liquid hydrocarbon combustion fuel selected from the group consisting of distillate fuels and fuel oils.

21. The composition of claim 20 wherein the fuel oil is selected from fuel oil numbers 1, 2 and 3 and diesel fuel oils and jet combustion fuels.

22. The composition of claim 21 wherein the fuel is a diesel fuel.

23. An additive concentrate solution comprising at least one inert liquid hydrocarbon solvent or mixture of solvents having dissolved therein an additive product of reaction produced by the reaction of a benzophenone tetracarboxylic dianhydride or acid equivalent and (1) an aminoalcohol or combination or mixture of aminoalcohols or (2) an aminoalcohol or combination or mixture of aminoalcohols and a secondary amine said reactants being reacted in substantially molar, less than molar or more than molar amounts at temperature varying from about 85° to about 250° C. under pressures varying from about ambient or autogeneous to slightly higher for a time sufficient to obtain the desired poly(aminoalcohol) additive product of reaction.

24. The additive concentrate solution of claim 23 wherein each 100 ml portion thereof contains dissolved therein from about 1 to about 50 grams of said additive product of reaction.

25. The additive concentrate solution of claim 24 wherein each 100 ml portion thereof contains about 10 grams of said additive product of reaction.

26. The additive concentrate of claim 23 wherein said solvent is mixed xylenes solvent.

27. A process for preparing an additive product of reaction suitable for use in liquid fuel compositions comprising reacting in substantially molar ratios, less than molar ratios or more than molar ratios a benzophenone tetracarboxylic dianhydride or acid equivalent and (1) an aminoalcohol or combination or mixture of aminoalcohols or (2) an aminoalcohol or combination or mixture of aminoalcohols and a secondary amine under reaction conditions varying from temperature of 85° to 250° C., pressure from ambient to slightly higher for a time sufficient to obtain the desired product and wherein the aminoalcohol is derived from an olefin epoxide and a secondary amine.

28. The process of claim 27 wherein the aminoalcohol is derived from di(hydrogenated tallow)amine and 1,2-epoxyoctadecane.

29. The process of claim 27 wherein the amine is ditallow amine and the olefin epoxide is 1,2-epoxyoctadecane.

30. The process of claim 27 wherein the epoxide is 1,2-epoxyeicosane and the amine is di(hydrogenated tallow)amine.

31. The process of claim 27 wherein the epoxide is a mixture of C20 to C24 alpha olefin epoxides.

32. The process of claim 27 wherein the epoxide is a mixture of C24 to C28 alpha olefin epoxides.

33. The process of claim 27 wherein said reaction product is a benzophenone tetracarboxylic dianhydride/aminoalcohol ester having the following structure:

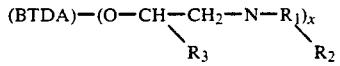

Where:

x=0.5–4

$R_1$, $R_3$=$C_8$–$C_{50}$ linear hydrocaryl groups, either saturated or unsaturated and $R_2$=$C_1$–$C_{100}$ hydrocarbyl or $C_8$–$C_{50}$ linear hydrocarbyl groups.

34. The process of claim 27 wherein said reaction product is a benzophenone tetracarboxylic dianhydride/aminoalcohol/amine ester/amide having the following structure:

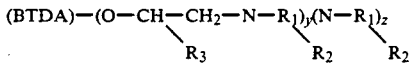

Where:

$y+z$=0.5–4

$R_1$, $R_3$=$C_8$–$C_{50}$ linear hydrocarbyl groups, either saturated or unsaturated and $R_2$=[$R_1$, ] $C_1$–$C_{100}$ hydrocarbyl or $C_8$–$C_{50}$ linear hydrocarbyl groups.

35. The process of claim 27 wherein the amine is selected from the group consisting of ditallow amine, di(hydrogenated tallow) amine, dioctadecylamine, methyloctadecylamine or mixtures thereof.

* * * * *